United States Patent [19]

Betticare

[11] Patent Number: 4,872,386

[45] Date of Patent: Oct. 10, 1989

[54] INTERCHANGEABLE PICK-UP FOR ELECTRIC GUITAR

[76] Inventor: Olivier Betticare, 82 Boulevard Davout, Paris, France, 75020

[21] Appl. No.: 202,935

[22] Filed: Jun. 6, 1988

[51] Int. Cl.[4] ..... G10H 3/18

[52] U.S. Cl. ..... 84/726

[58] Field of Search ..... 84/1.14–1.16

[56] References Cited

U.S. PATENT DOCUMENTS

| | | | |
|---|---|---|---|
| 3,475,543 | 10/1969 | Burns | 84/1.15 |
| 3,869,952 | 3/1975 | Rowe | 84/1.16 |
| 3,911,777 | 10/1975 | Rendell | 84/1.16 |
| 4,151,776 | 5/1979 | Stich | 84/1.16 |
| 4,282,789 | 8/1981 | Lamborn | 84/1.15 |
| 4,394,830 | 7/1983 | Damiano | 84/1.15 |
| 4,501,186 | 2/1985 | Ikuma | 84/1.16 |
| 4,616,548 | 10/1986 | Anderson | 84/1.16 |

FOREIGN PATENT DOCUMENTS 527400 8/1978 Australia .

2119148 11/1983 United Kingdom .

*Primary Examiner*—Stanley J. Witkowski

*Attorney, Agent, or Firm*—Charles E. Temko

[57] ABSTRACT

An interchangeable pick-up construction for standard electric guitars in which the guitar body is provided with a recess. A pick-up engaging means is permanently installed within the recess, the engagement means forming a pair of oppositely disposed grooves which extend transversely with respect to the longitudinal access of the guitar body. The pick-up element includes the usual electrical components, and a conductive plate, the longitudinal side edges of which are selectively engageable within the grooves to a predetermined position in which electrical communication is established between the pick-up coil and contacts in the pick-up engaging means. In a second embodiment, means is provided for adjusting the relative position between the pick-up engaging means and the guitar body, so as to adjust the position of the pick-up element relative to strings carried by the guitar body.

4 Claims, 3 Drawing Sheets

INTERCHANGEABLE PICK-UP FOR ELECTRIC GUITAR

BACKGROUND OF THE INVENTION

This invention relates generally to the field of electric guitars, and more particularly to an improved interchangeable pick-up construction permitting the rapid engagement of a selected pick-up element with the guitar for providing desired tonal effects. Devices of this general type are known in the art, and the invention lies in specific instructional details which enable incorporation into almost any guitar, and substantially complete interchangeability without the use of tools.

SUMMARY OF THE INVENTION

Briefly stated, the invention contemplates the provision of an improved interchangeable pick-up structure in which the guitar body is provided with a recess accommodating a pick-up engagement means, the means defining a pair of opposed grooves extending transversely with respect to the principal access of the guitar body. The interchangeable pick-up element is provided with a mounting plate having longitudinal edges which engage the opposed grooves to be frictionally engaged there-between. A transversely extending ramp provides a detent to further assist in maintaining the pick-up element in position, whereby the necessary electrical contacts interconnecting the pick-up element to other electrical components on the guitar body are made.

BRIEF DESCRIPTION OF THE DRAWINGS

In the drawings, to which reference will be made in the specification, similar reference characters have been employed to designate corresponding parts throughout the several views.

FIGS. 7, 8 and 9 are side, top and front views, respectively, of a pickup used in the invention.

DETAILED DESCRIPTION OF THE DISCLOSED EMBODIMENTS

Figure 1:
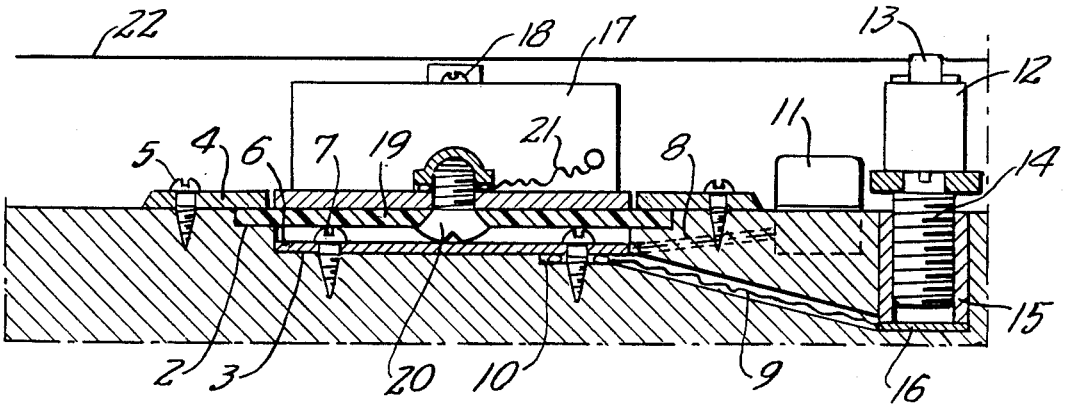
FIG. 1 is a schematic fragmentary cross-sectional view of a first embodiment of the invention.

In accordance with the invention, and with reference to FIGS. 1 to 4, inclusive, the first embodiment comprises a guitar body 1, which may be of any conventional type. Normally, in the case of an electric guitar, there is no hollow sound box, and the body is of generally plain art configuration. The body is inletted to form grooves 2 which accommodates a plate on a pick-up element, as well as a notch 3 which accommodates corresponding structure on the guitar body.

Reference character 4 identifies plates which enclose the grooves 2, and which are secured to the guitar body by screws 5. Electric contract plates 6 are of metal, and are secured by screws 7. A first conductor 8 communicates with the string bridge 12. The conductor 8 is guided through a channel 10 for this purpose.

Reference character 13 designates an adjustment stud of the string bridge adjacent to the strings. The bridge is secured to the body by screws 14 engaging long cylindrical bolts 15 seated in a notch 16 in the body of the guitar.

A pick-up element is indicated generally by reference character 17, and may be one of several pick-up elements which are selectively engageable. It is provided with magnetic studs 18 adapted to underly the strings 22 of the instrument at a supporting plate 19 which may be of insulate material. Beneath each of the studs 18 is a screw-bolt 20 the lower end of which touches the contact plate 3 for electrical communication. Conductors 21 interconnect the coils 28 of the pick-up with the bolts 20 in known manner.

The strings 22 extend longitudinally of the guitar body, and are supported by the bridge 12 in conventional manner.

The pick-up element is provided with a cover 25 held in position by screw 24 to protect the coils.

Figure 2:
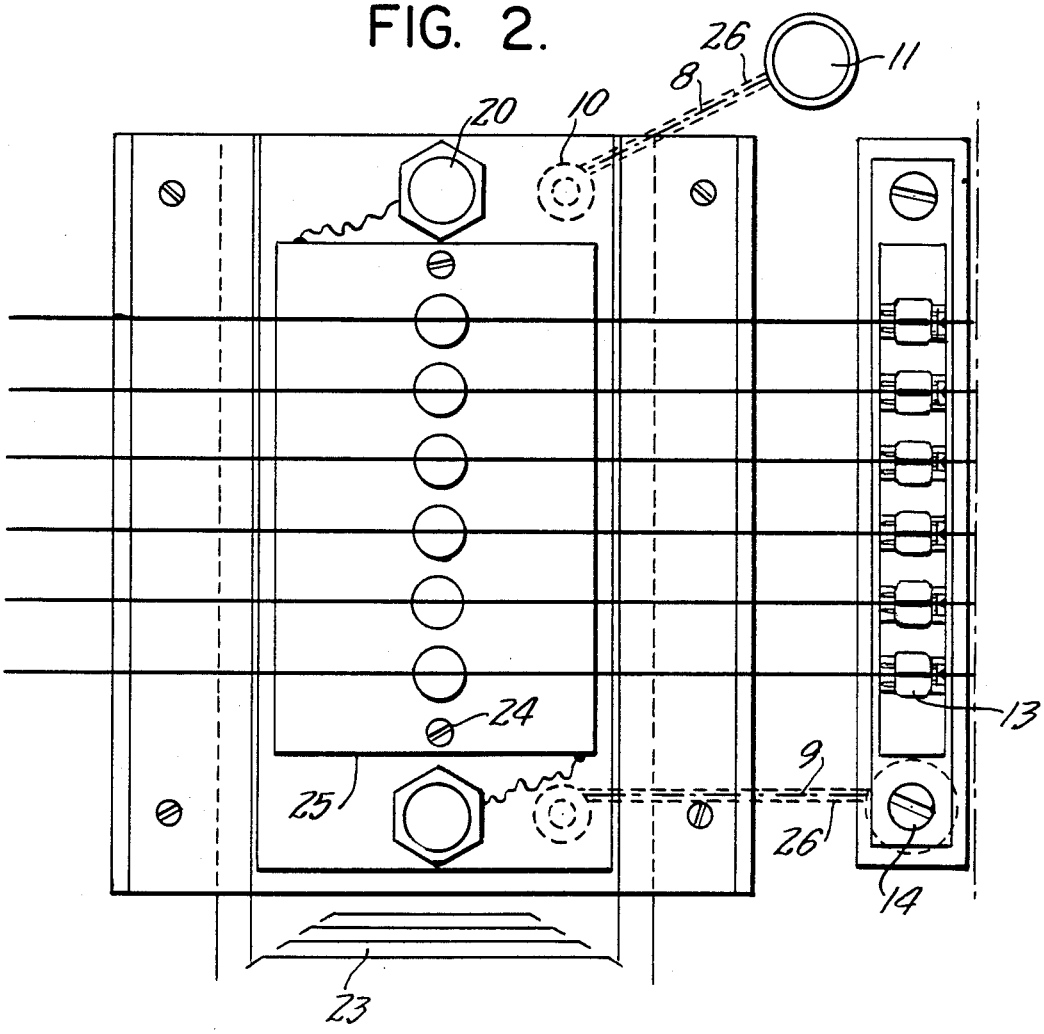
FIG. 2 is a fragmentary schematic top plan thereof as seen from the upper portion of FIG. 1.
Figure 3:
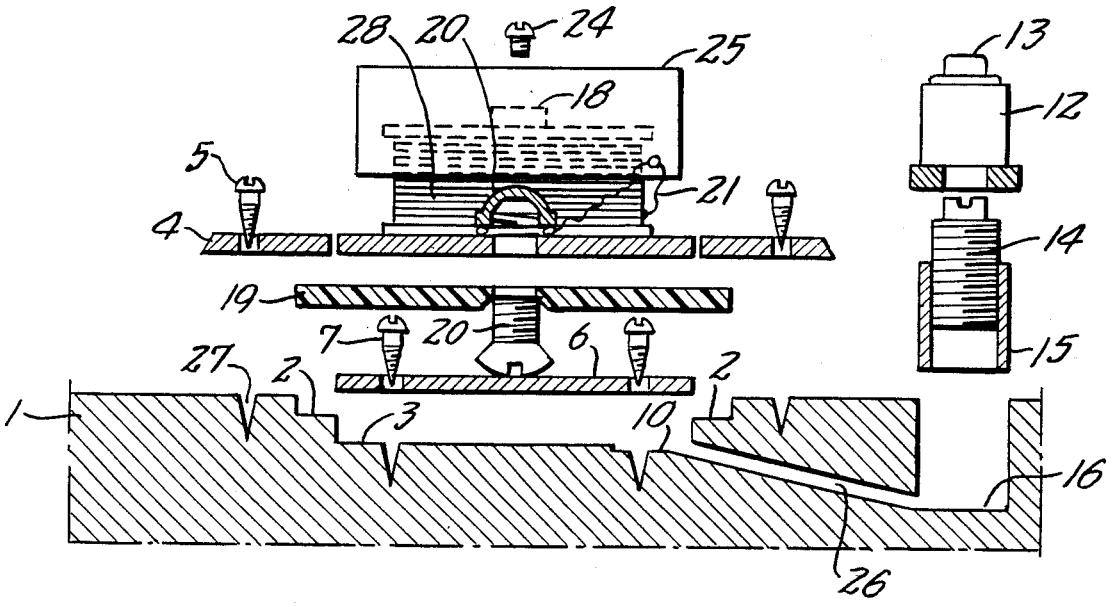
FIG. 3 is an exploded view in section corresponding to FIG. 1.
Figure 4:
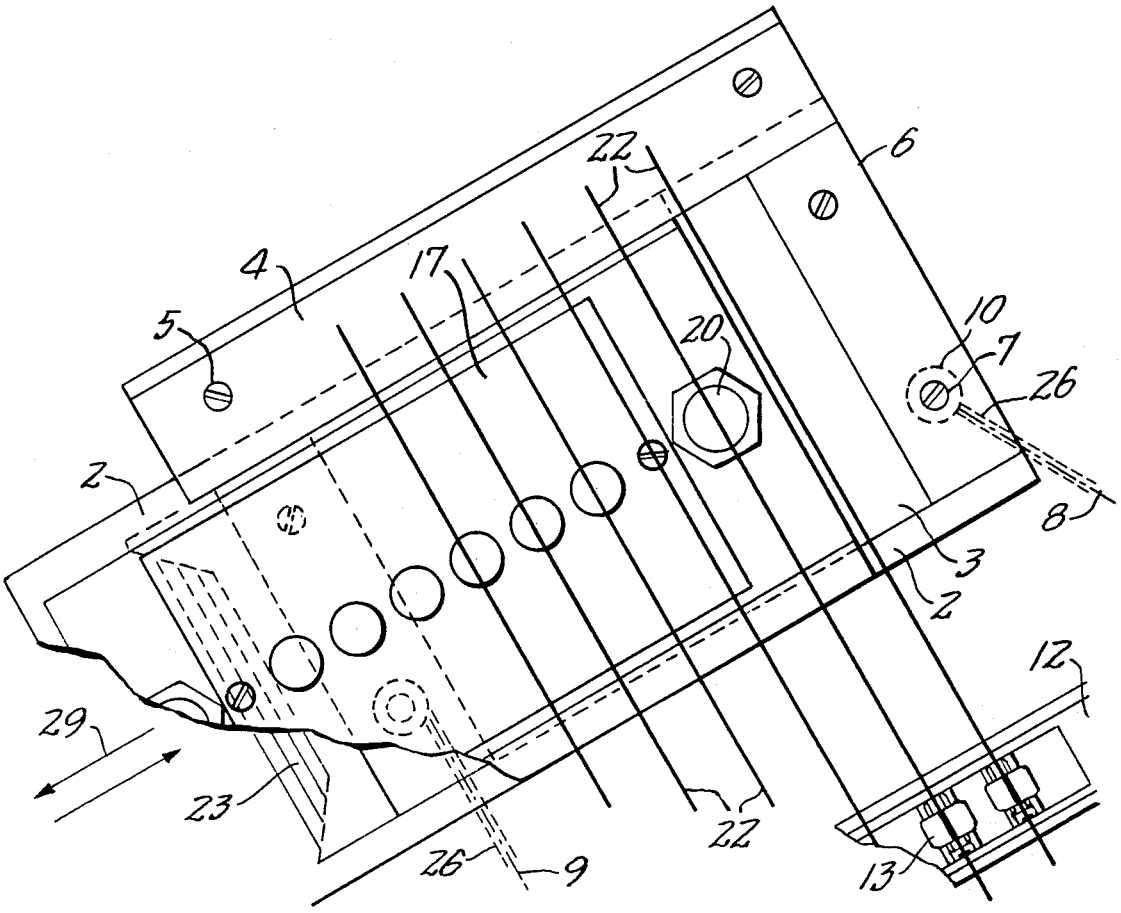
FIG. 4 is a fragmentary top plan view corresponding to that scene in FIG. 2.

Normally, the pick-up element is engaged by merely sliding the same transversely within the grooves 2 to the position shown in FIG. 2. It is maintained in this position by a detent 23 over which the support plate 19 passes.

Reference character 26 indicates a passage in the guitar body for the conductor 8. Reference character 29 indicates the direction of movement of the pick-up element relative to the guitar body upon engagement and disengagement. From a consideration of FIG. 4, it will be apparent that a leftward end of the pick-up element is readily accessible to the user for this purpose.

Figure 5:
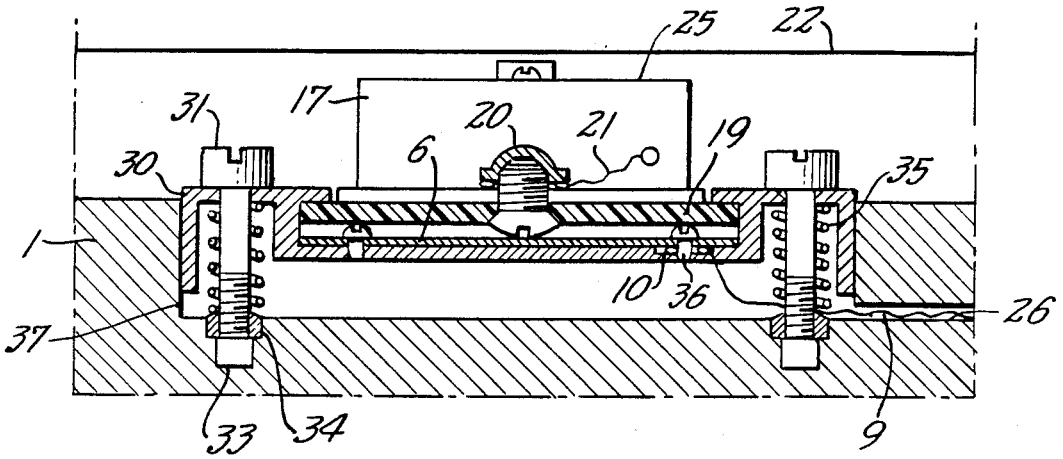
FIG. 5 is a fragmentary sectional view corresponding to that scene in FIG. 1, but showing a second embodiment of the invention.
Figure 6:
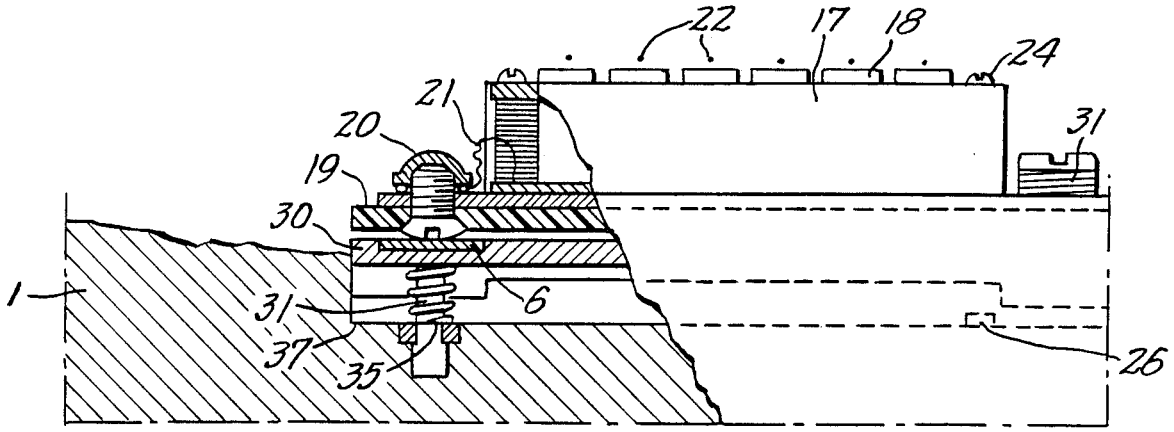
FIG. 6 is a view and elevation, partly in section, as seen from the right-hand portion of FIG. 5.

Turning now to FIGS. 5 and 6 in the drawing, there is illustrated an alternate form of the embodiment in which provision has been incorporated for adjusting the height of the pick-up element with respect to the strings 22. This is accomplished by providing a removable body 30 which is mounted on four screw-nuts 31 which engage both 32 positioned within cavities 33 and 34. Springs 35 urge the body 30 upperwardly against the adjustment of the screws 31 in known manner. Electrical communication is established through the screws 20, plate 6, and screws 336, as in the first embodiment.

Referring to FIGS. 7, 8 and 9, a metal plate or skate 38 is positioned on the undersurface of the plate 19 to afford communication with the pick-up element retaining means, thus providing for a small degree of tolerance in establishing electrical communication. The plate 38 communicates with a conductor 21 which extends to a point 39 on the coil (FIG. 7).

I wish it to be understood that I do not consider the invention to be limited to the precise details as shown and set forth in this specification, for obvious modifications will occur to those skilled in the art to which the invention pertains.

I claim:

1. In a combination electric guitar body and Interchangeable pick-up element therefor in which the pick-up element is placed in electrical communication with the string bridge of the guitar body upon engagement with said body, the improvement comprising: said guitar body defining a recess, pick-up mounting means disposed in said recess, said mounting means defining a pair of opposed transversely extending grooves, said pick-up element having a plate having opposed longitudinal edges slidably engaged with said grooves; said pick-up mounting means including conductive terminals, said pick-up element having corresponding terminals selectively engaging said conductive terminals upon engaging said pick-up element in predetermined position relative to said pick-up mounting means.

2. The improvement set forth in claim 1, further comprising adjusting means on said pick-up mounting means for varying the location of said pick-up element in engaged condition relative to strings on said guitar body.

3. The improvement set forth in claim 2 further characterized in said adjusting means comprising threaded means interconnecting said mounting means with said guitar body.

4. The improvement set forth in claim 1, further characterized in said pick-up element comprising a mounting plate adding conductive areas on a lower surface thereof, said mounting means comprising terminals for slidably engaging said conductive areas.

* * * * *